US012714150B2

(12) United States Patent
Kim et al.

(10) Patent No.: US 12,714,150 B2
(45) Date of Patent: Aug. 25, 2026

(54) AEROSOL GENERATING APPARATUS AND METHOD FOR CONTROLLING HEATING TIME OF HEATER

(71) Applicant: KT&G CORPORATION, Daejeon (KR)

(72) Inventors: Yong Hwan Kim, Anyang-si (KR); Sung Wook Yoon, Suwon-si (KR); Seung Won Lee, Gwangmyeong-si (KR); Seok Su Jang, Daejeon (KR); Dae Nam Han, Seoul (KR)

(73) Assignee: KT&G CORPORATION, Daejeon (KR)

( * ) Notice: Subject to any disclaimer, the term of this patent is extended or adjusted under 35 U.S.C. 154(b) by 401 days.

(21) Appl. No.: 18/038,609

(22) PCT Filed: Dec. 28, 2021

(86) PCT No.: PCT/KR2021/095142
§ 371 (c)(1),
(2) Date: May 24, 2023

(87) PCT Pub. No.: WO2022/149808
PCT Pub. Date: Jul. 14, 2022

(65) Prior Publication Data

US 2024/0008549 A1 Jan. 11, 2024

(30) Foreign Application Priority Data

Jan. 5, 2021 (KR) ..... 10-2021-0000842

(51) Int. Cl.
*A24F 40/51* (2020.01)
*A24F 40/20* (2020.01)
(Continued)

(52) U.S. Cl.
CPC ..... *A24F 40/51* (2020.01); *A24F 40/20* (2020.01); *A24F 40/465* (2020.01); *A24F 40/53* (2020.01); *A24F 40/57* (2020.01)

(58) Field of Classification Search
None
See application file for complete search history.

(56) References Cited

U.S. PATENT DOCUMENTS 11,044,945 B2 6/2021 Nakano et al.
2014/0345633 A1 11/2014 Talon et al.
(Continued)

FOREIGN PATENT DOCUMENTS

CN 103974638 A 8/2014
CN 106455724 A 2/2017
(Continued)

OTHER PUBLICATIONS

English Translation of KR20200005082A (Year: 2025).*
(Continued)

*Primary Examiner* — Katherine A Will
(74) *Attorney, Agent, or Firm* — Foley & Lardner LLP

(57) ABSTRACT

An aerosol generating apparatus includes: a heater configured to heat an aerosol generating substrate; a puff sensor configured to measure an amount of a user's puff; and a controller configured to determine a vaporization amount of the aerosol generating substrate, based on a puff sensing value indicating the amount of the user's puff, and control a heating time of the heater, based on the determined vaporization amount.

9 Claims, 6 Drawing Sheets

(51) Int. Cl.

| | |
|---|---|
| ***A24F 40/465*** | (2020.01) |
| ***A24F 40/53*** | (2020.01) |
| ***A24F 40/57*** | (2020.01) |

(56) References Cited

U.S. PATENT DOCUMENTS

| | | | |
|---|---|---|---|
| 2017/0027229 | A1 | 2/2017 | Cameron |
| 2017/0347704 | A1 | 12/2017 | Oishi |
| 2019/0133198 | A1 | 5/2019 | Nakano et al. |
| 2020/0093187 | A1 | 3/2020 | Dickens |
| 2020/0154773 | A1 | 5/2020 | Lim et al. |
| 2020/0352246 | A1 | 11/2020 | Yamada et al. |
| 2020/0359681 | A1 | 11/2020 | Han et al. |
| 2021/0127748 | A1 | 5/2021 | Lim et al. |
| 2022/0142249 | A1 | 5/2022 | Lim et al. |
| 2022/0211113 | A1 | 7/2022 | Ruscio et al. |
| 2022/0240590 | A1 | 8/2022 | Louveau et al. |
| 2022/0322746 | A1 | 10/2022 | Talon |
| 2023/0329352 | A1 | 10/2023 | Lim et al. |

FOREIGN PATENT DOCUMENTS

| | | | |
|---|---|---|---|
| CN | 110545682 | A | 12/2019 |
| CN | 111685394 | A | 9/2020 |
| CN | 111772247 | A | 10/2020 |
| JP | 2019-071885 | A | 5/2019 |
| JP | 2020-518235 | A | 6/2020 |
| KR | 10-2014-0118985 | A | 10/2014 |
| KR | 10-1868727 | B1 | 6/2018 |
| KR | 10-2019-0032438 | A | 3/2019 |
| KR | 10-2019-0094978 | A | 8/2019 |
| KR | 10-2020-0005082 | A | 1/2020 |
| KR | 10-2020-0098679 | A | 8/2020 |
| RU | 2 736 923 | C2 | 11/2020 |
| WO | 2018/020619 | A1 | 2/2018 |
| WO | 2019/243464 | A1 | 12/2019 |
| WO | WO-2020/009457 | A1 | 1/2020 |
| WO | WO-2020/216765 | A1 | 10/2020 |

OTHER PUBLICATIONS

English translation of Lim et al. (CN110545682A) (Year: 2019).*
Russian Office Action dated Dec. 13, 2023 in Russian Application No. 2023116843.
International Search Report for PCT/KR2021/095142 dated Apr. 12, 2022.
Written Opinion for PCT/KR2021/095142 dated Apr. 12, 2022.
Korean Notice of Non-Final Rejection Office Action for Korean Application No. 10-2021-0000842 dated Nov. 1, 2022.
Korean Notice of Final Rejection Office Action for Korean Application No. 10-2021-0000842 dated Jan. 13, 2023.
Communication dated Mar. 4, 2024 issued by the European Patent Office in application No. 21917969.4.
Chinese Office Action on CN Patent Application No. 202180088222.1 dated Sep. 15, 2025.
Notice of Reasons for Refusal Office Action on Japanese Application No. 2023-540823 dated Jul. 24, 2024 (6 pages).

* cited by examiner

【Figure 1】
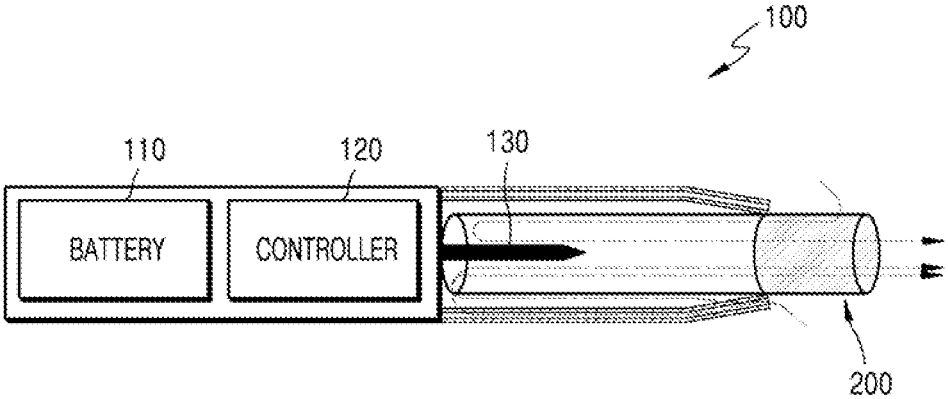
【Figure 2】
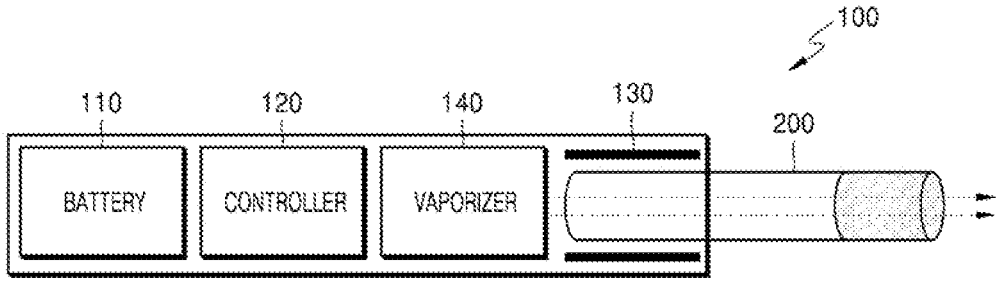
【Figure 3】
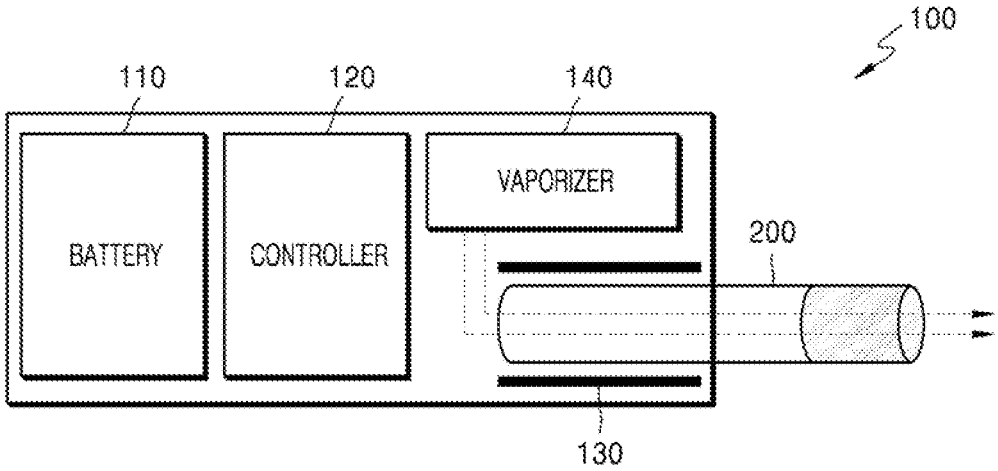

【Figure 4】
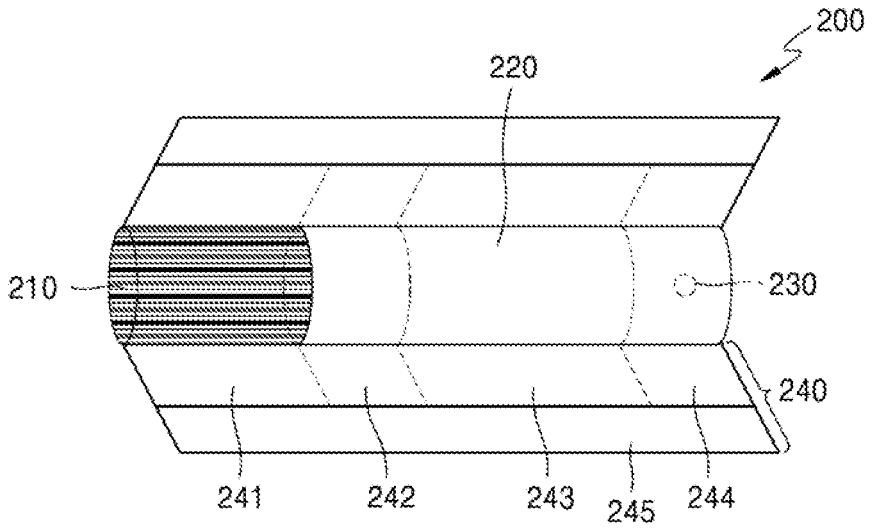
【Figure 5】
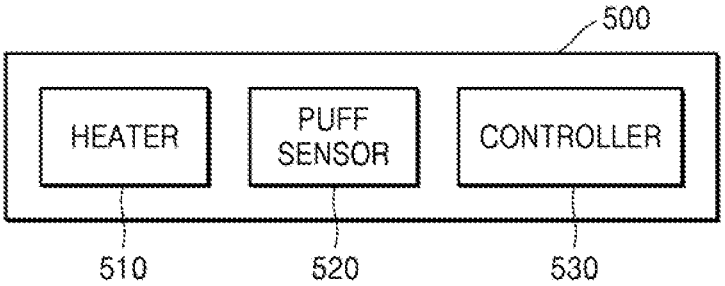
【Figure 6】
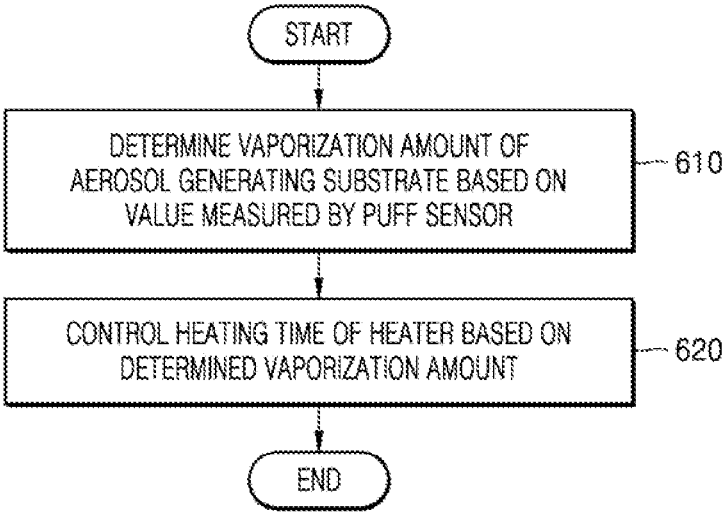

[Figure 7]
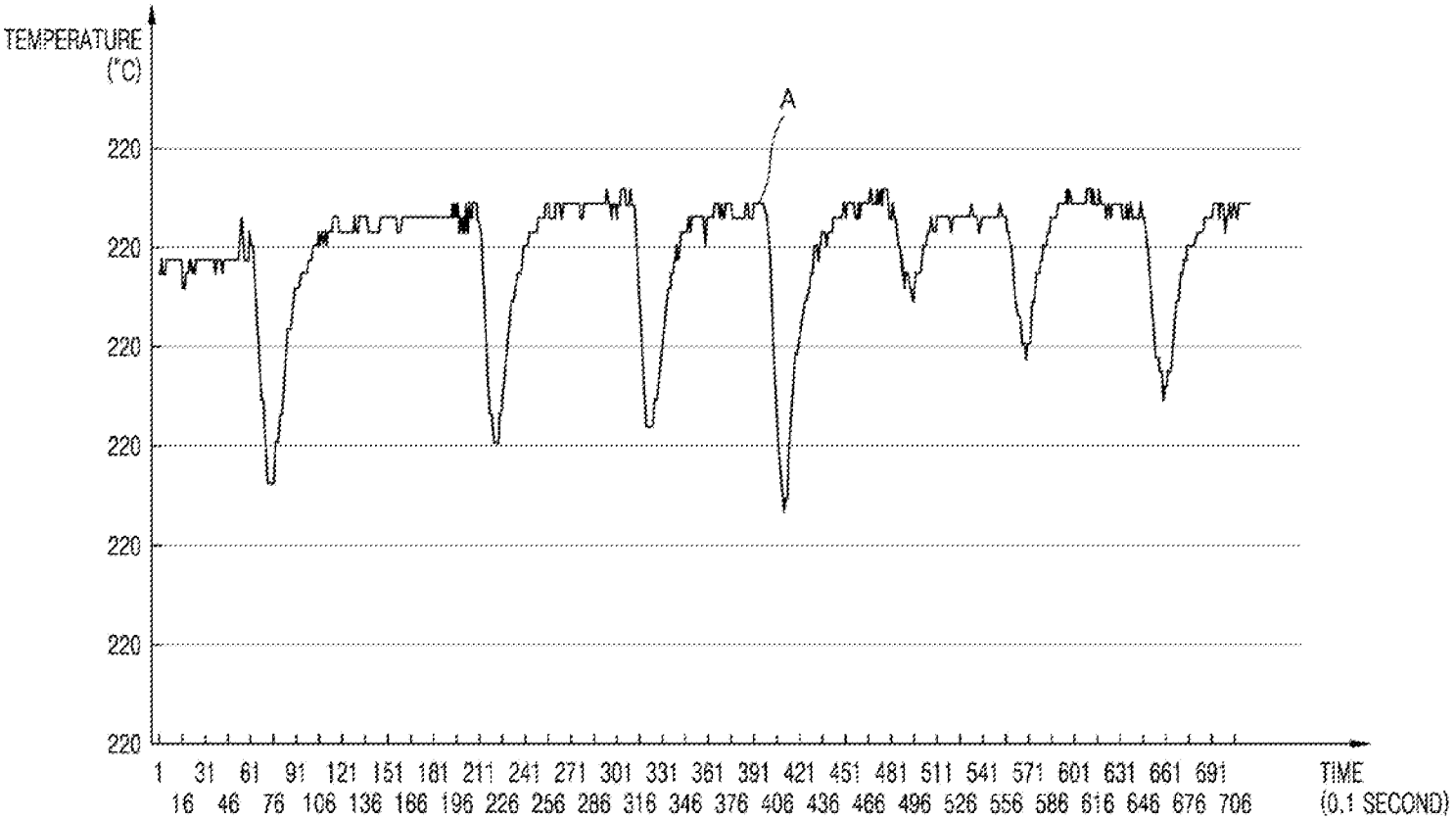

[Figure 8]
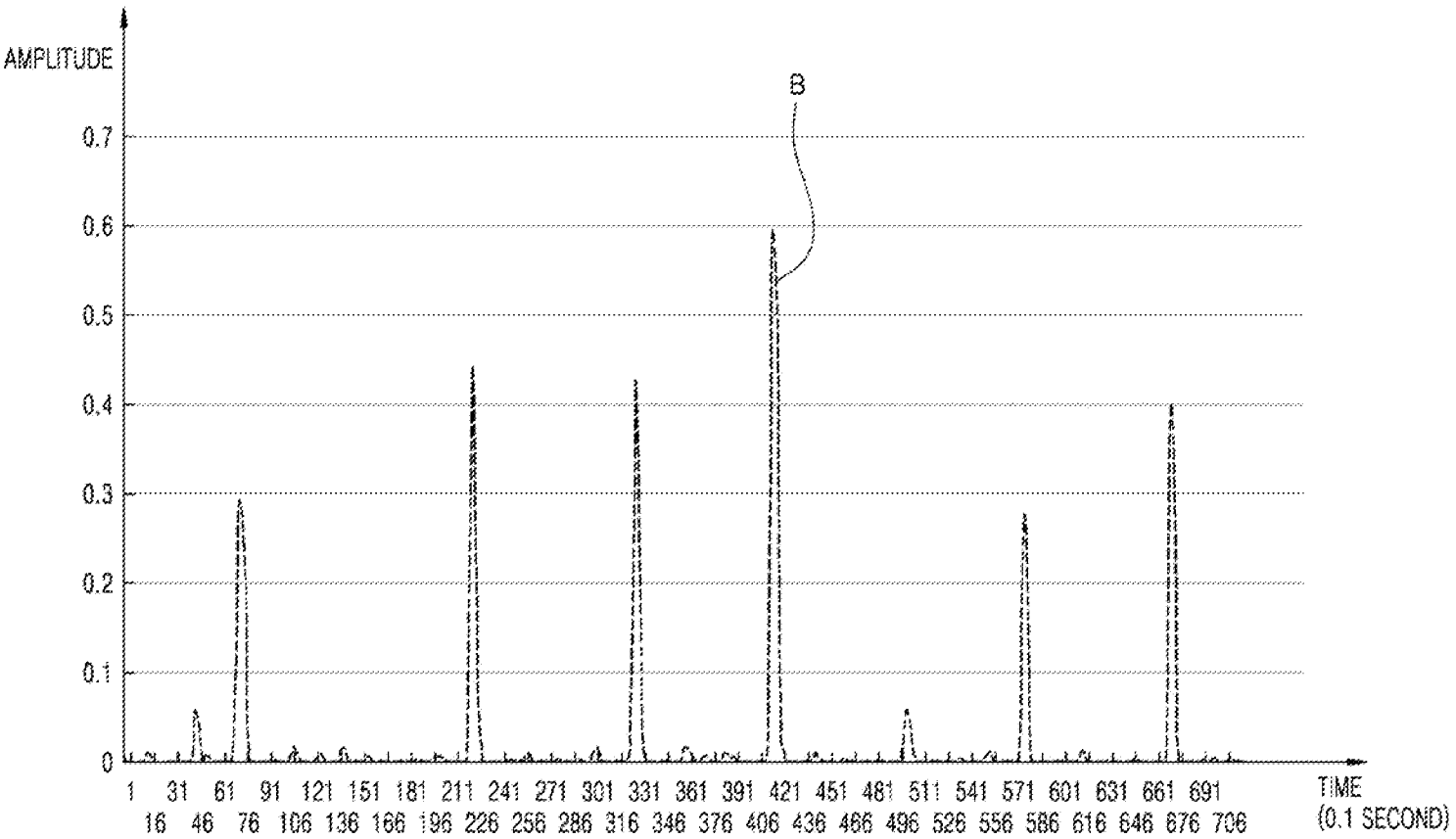

[Figure 9]
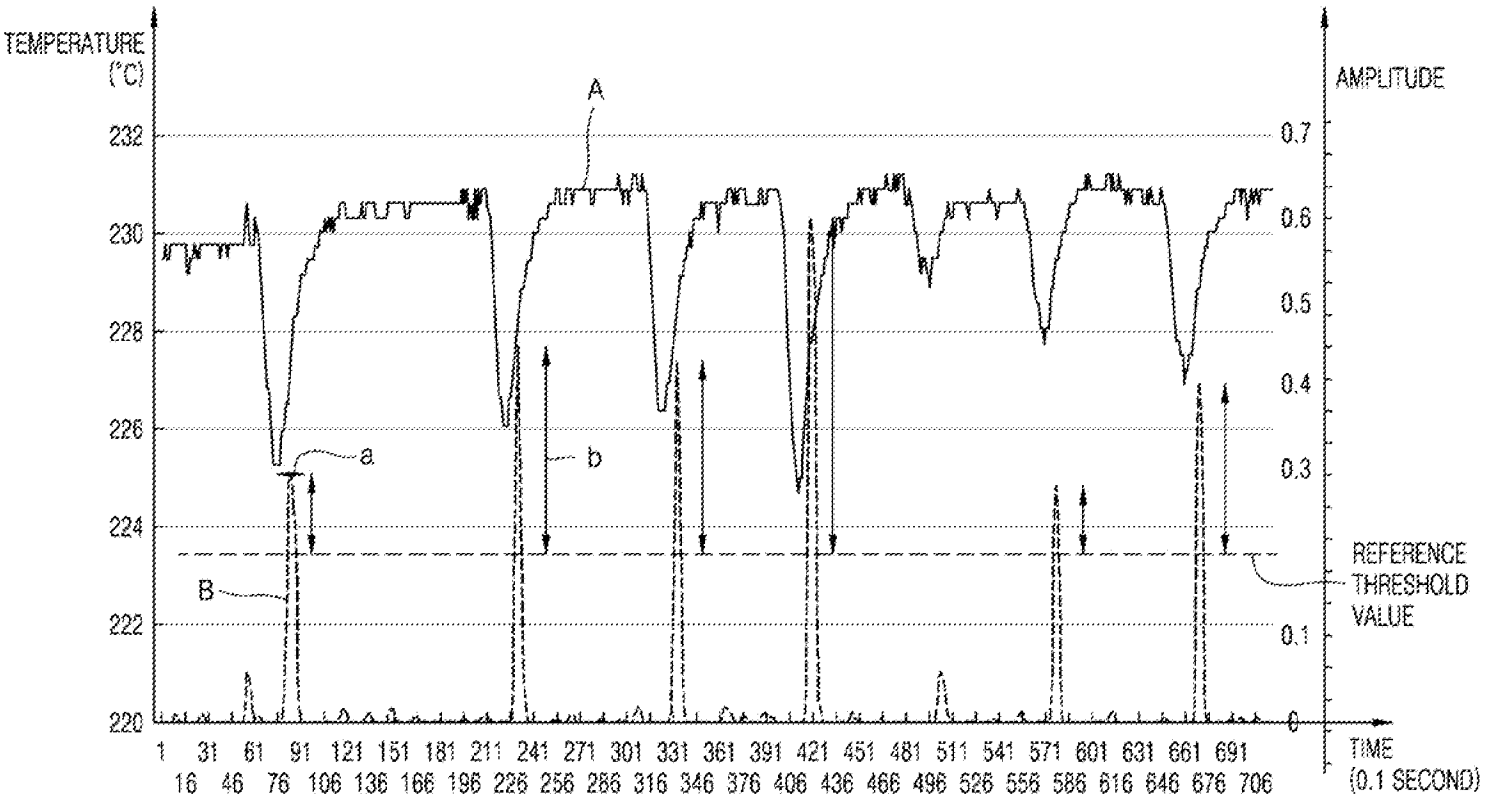

【Figure 10】
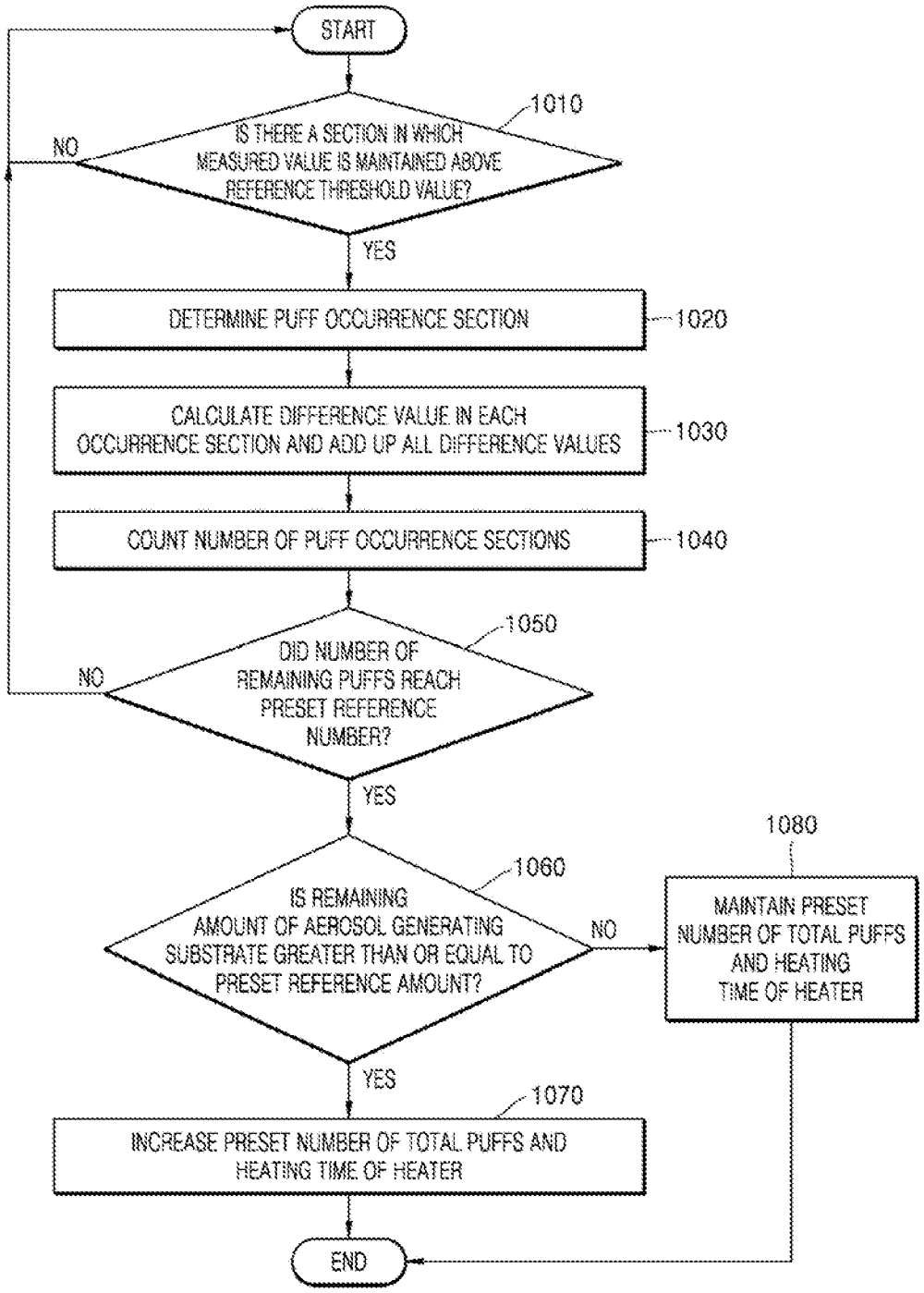

AEROSOL GENERATING APPARATUS AND METHOD FOR CONTROLLING HEATING TIME OF HEATER

CROSS REFERENCE TO RELATED APPLICATIONS

This application is a National Stage of International Application No. PCT/KR2021/095142 filed Dec. 28, 2021, claiming priority based on Korean Patent Application No. 10-2021-0000842 filed Jan. 5, 2021.

TECHNICAL FIELD

The disclosure relates to an aerosol generating apparatus and method for controlling a heating time of a heater.

BACKGROUND ART

Recently, the demand for alternatives to a traditional cigarette has increased. For example, there is growing demand for an aerosol generating device which generates an aerosol by heating an aerosol generating material in aerosol generating articles, without combusting aerosol generating articles. Accordingly, researches on a heating-type aerosol generating article and a heating-type aerosol generating device have been actively conducted.

In an aerosol generating apparatus, a heater is used to heat an aerosol generating substrate (i.e., aerosol generating material), and the heating time of a heater needs to be differently set according to the degree of vaporization of the aerosol generating substrate. Accordingly, there is a need for technology to control the heating time of a heater based on the available vaporization amount of the aerosol generating substrate.

DISCLOSURE

Technical Problem

An aerosol generating apparatus may control the heating time of a heater such that the heater only operates for a certain time preset for each aerosol generating article.

However, when the heater heats the aerosol generating substrate only for a preset time, the user may not be able to continue smoking after the time has expired even if the remaining amount of the aerosol generating substrate is sufficient to provide additional puffs.

Various embodiments provide, as a solution to improve the above-described problems, an aerosol generating apparatus and method of controlling a heating time of a heater. The technical objectives to be achieved by the disclosure are not limited to the above-described objectives, and other technical objectives may be inferred from the following embodiments.

Technical Solution

One or more embodiments provide an aerosol generating apparatus capable of controlling the heating time of a heater based on the remaining amount of the aerosol generating substrate.

According to one aspect of the disclosure, provided is an aerosol generating apparatus, which includes a heater configured to heat an aerosol generating substrate, a puff sensor configured to measure an amount of a user's puff, and a controller configured to determine a vaporization amount of the aerosol generating substrate based on a puff sensing value indicating the amount of the user's puff, and control a heating time of the heater based on the determined vaporization amount.

Furthermore, according to another aspect of the disclosure, provided is a method of controlling an aerosol generating apparatus, which includes heating the aerosol generating substrate, measuring an amount of a user's puff by using a puff sensor, determining a vaporization amount of an aerosol generating substrate based on a puff sensing value indicating the amount of the user's puff, and controlling a heating time of a heater based on the determined vaporization amount.

Advantageous Effects

The disclosure may provide an aerosol generating apparatus and method of controlling a heating time of a heater.

In detail, the aerosol generating apparatus according to the disclosure may determine the vaporization amount (i.e., consumed amount) of the aerosol generating substrate based on a value measured by a puff sensor, and control the heating time of a heater based on the determined vaporization amount.

Accordingly, the heater may continue to heat the aerosol generating substrate even after a preset time set for smoking one aerosol generating article has passed, and thus a user may continue smoking and user convenience may be increased. Furthermore, waste of an aerosol generating article may be prevented.

The effects of the disclosure are not limited to the contents disclosed herein, and other various effects may be further included in the specification.

DESCRIPTION OF DRAWINGS

FIGS. 1 through 3 are diagrams showing examples in which an aerosol generating article is inserted into an aerosol generating device.

FIG. 4 illustrates an example of the aerosol generating article.

FIG. 5 is a view showing a configuration of an aerosol generating apparatus according to an embodiment.

FIG. 6 is a flowchart of a method of operating an aerosol generating apparatus, according to an embodiment.

FIG. 7 is a graph showing the temperature of a heater measured by a puff sensor, according to an embodiment.

FIG. 8 is a graph showing a puff sensing value output by the puff sensor, according to an embodiment.

FIG. 9 is a graph showing a vaporization amount of the aerosol generating substrate, according to an embodiment.

FIG. 10 is a flowchart of a method of controlling, by the aerosol generating apparatus, the heating time of a heater based on a vaporization amount, according to an embodiment.

MODE FOR INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Furthermore, in the following embodiments, ordinal terms such as "first," "second," etc. may be only used to distinguish one component from another, and the components must not be limited by such terms.

The term "aerosol generating article" may refer to a product designed for smoking by a person puffing on the aerosol generating article. The aerosol generating article may include an aerosol generating material (i.e., aerosol generating substrate) that generates aerosols without combustion. For example, one or more aerosol generating articles may be loaded in an aerosol generating device and generate aerosols when heated by the aerosol generating device. The shape, size, material, and structure of the aerosol generating article may differ according to embodiments. Examples of the aerosol generating article may include, but are not limited to, a cigarette and a cartridge.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIGS. 1 through 3 are diagrams showing examples in which an aerosol generating article is inserted into an aerosol generating device.

Referring to FIG. 1, the aerosol generating device 100 may include a battery 110, a controller 120, and a heater 130. Referring to FIGS. 2 and 3, the aerosol generating device 100 may further include a vaporizer 140. Also, the aerosol generating article 200 may be inserted into an inner space of the aerosol generating device 100.

FIGS. 1 through 3 illustrate components of the aerosol generating device 100, which are related to the present embodiment. Therefore, it will be understood by one of ordinary skill in the art related to the present embodiment that other general-purpose components may be further included in the aerosol generating device 100, in addition to the components illustrated in FIGS. 1 through 3.

Also, FIGS. 2 and 3 illustrate that the aerosol generating device 100 includes the heater 130. However, as necessary, the heater 130 may be omitted.

FIG. 1 illustrates that the battery 110, the controller 120, and the heater 130 are arranged in series. Also, FIG. 2 illustrates that the battery 110, the controller 120, the vaporizer 140, and the heater 130 are arranged in series. Also, FIG. 3 illustrates that the vaporizer 140 and the heater 130 are arranged in parallel. However, the internal structure of the aerosol generating device 100 is not limited to the structures illustrated in FIGS. 1 through 3. In other words, according to the design of the aerosol generating device 100, the battery 110, the controller 120, the heater 130, and the vaporizer 140 may be differently arranged.

When the aerosol generating article 200 is inserted into the aerosol generating device 100, the aerosol generating device 100 may operate the heater 130 and/or the vaporizer 140 to generate aerosol from the aerosol generating article 200 and/or the vaporizer 140. The aerosol generated by the heater 130 and/or the vaporizer 140 is delivered to a user by passing through the aerosol generating article 200.

As necessary, even when the aerosol generating article 200 is not inserted into the aerosol generating device 100, the aerosol generating device 100 may heat the heater 130.

The battery 110 may supply power to be used for the aerosol generating device 100 to operate. For example, the battery 110 may supply power to heat the heater 130 or the vaporizer 140, and may supply power for operating the controller 120. Also, the battery 110 may supply power for operations of a display, a sensor, a motor, etc. mounted in the aerosol generating device 100.

The controller 120 may generally control operations of the aerosol generating device 100. In detail, the controller 120 may control not only operations of the battery 110, the heater 130, and the vaporizer 140, but also operations of other components included in the aerosol generating device 100. Also, the controller 120 may check a state of each of the components of the aerosol generating device 100 to determine whether or not the aerosol generating device 100 is able to operate.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 130 may be heated by the power supplied from the battery 110. For example, when the aerosol generating article 200 is inserted into the aerosol generating device 100, the heater 130 may be located outside the aerosol generating article 200. Thus, the heated heater 130 may increase a temperature of an aerosol generating material in the aerosol generating article 200.

The heater 130 may include an electro-resistive heater. For example, the heater 130 may include an electrically conductive track, and the heater 130 may be heated when currents flow through the electrically conductive track. However, the heater 130 is not limited to the example described above and may include all heaters which may be heated to a desired temperature. Here, the desired temperature may be pre-set in the aerosol generating device 100 or may be set by a user.

For example, the heater 130 may include a tube-type heating element, a plate-type heating element, a needle-type heating element, or a rod-type heating element, and may heat the inside or the outside of the aerosol generating article 200, according to the shape of the heating element.

As another example, the heater 130 may include an induction heater. In detail, the heater 130 may include an electrically conductive coil for heating an aerosol generating article in an induction heating method, and the aerosol generating article may include a susceptor which may be heated by the induction heater. The susceptor may be tubular or cylindrical, and may be arranged to surround an accommodation space into which the aerosol generating article 200 (e.g., cigarette) is inserted. When the aerosol generating article 200 is inserted in the accommodation space of the aerosol generating apparatus 100, the susceptor may surround the aerosol generating article 200. Accordingly, the temperature of the aerosol generating substrate in the aerosol generating article 200 may be increased by the heat transferred from the external susceptor. An induction coil may generate a variable magnetic field as power is supplied from the battery 110 thereto. The variable magnetic field generated by the induction coil may be applied to the susceptor so that the susceptor is heated. The power supplied to the induction coil may be controlled by the controller 120 such that the temperature of the susceptor is maintained in an appropriate range.

Also, the aerosol generating device 100 may include a plurality of heaters 130. Here, the plurality of heaters 130 may be inserted into the aerosol generating article 200 or may be arranged outside the aerosol generating article 200. Also, some of the plurality of heaters 130 may be inserted into the aerosol generating article 200 and the others may be arranged outside the aerosol generating article 200. In addition, the shape of the heater 130 is not limited to the shapes illustrated in FIGS. 1 through 3 and may include various shapes.

The vaporizer 140 may generate aerosol by heating a liquid composition and the generated aerosol may pass through the aerosol generating article 200 to be delivered to a user. In other words, the aerosol generated via the vaporizer 140 may move along an air flow passage of the aerosol generating device 100 and the air flow passage may be configured such that the aerosol generated via the vaporizer 140 passes through the aerosol generating article 200 to be delivered to the user.

For example, the vaporizer 140 may include a liquid storage, a liquid delivery element, and a heating element, but it is not limited thereto. For example, the liquid storage, the liquid delivery element, and the heating element may be included in the aerosol generating device 100 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 140 or may be formed integrally with the vaporizer 140.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 140 may be referred to as a cartomizer or an atomizer, but it is not limited thereto.

The aerosol generating device 100 may further include general-purpose components in addition to the battery 110, the controller 120, the heater 130, and the vaporizer 140. For example, the aerosol generating device 100 may include a display capable of outputting visual information and/or a motor for outputting haptic information. Also, the aerosol generating device 100 may include at least one sensor (e.g., a puff sensor, a temperature sensor, an aerosol generating article insertion detecting sensor, etc.). Also, the aerosol generating device 100 may be formed as a structure that, even when the aerosol generating article 200 is inserted into the aerosol generating device 100, may introduce external air or discharge internal air.

Although not illustrated in FIGS. 1 through 3, the aerosol generating device 100 and an additional cradle may form together a system. For example, the cradle may be used to charge the battery 110 of the aerosol generating device 100. Alternatively, the heater 130 may be heated when the cradle and the aerosol generating device 100 are coupled to each other.

The aerosol generating article 200 may be similar to a general combustive cigarette. For example, the aerosol generating article 200 may be divided into a first portion including an aerosol generating material and a second portion including a filter, etc. Alternatively, the second portion of the aerosol generating article 200 may also include an aerosol generating material. For example, an aerosol generating material made in the form of granules or capsules may be inserted into the second portion.

The entire first portion may be inserted into the aerosol generating device 100, and the second portion may be exposed to the outside. Alternatively, only a portion of the first portion may be inserted into the aerosol generating device 100, or the entire first portion and a portion of the second portion may be inserted into the aerosol generating device 100. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 100. For example, opening and closing of the air passage and/or a size of the air passage formed in the aerosol generating device 100 may be adjusted by the user. Accordingly, the amount and the quality of smoking may be adjusted by the user. As another example, the external air may flow into the aerosol generating article 200 through at least one hole formed in a surface of the aerosol generating article 200.

Hereinafter, the examples of the aerosol generating article 200 will be described with reference to FIG. 4.

FIG. 4 illustrates examples of the aerosol generating article.

Referring to FIG. 4, the aerosol generating article 200 may include a tobacco rod 210 and a filter rod 220. The first portion described above with reference to FIGS. 1 through 3 may include the tobacco rod 210, and the second portion may include the filter rod 220.

FIG. 4 illustrates that the filter rod 220 includes a single segment. However, the filter rod 220 is not limited thereto. In other words, the filter rod 220 may include a plurality of segments. For example, the filter rod 220 may include a first segment configured to cool an aerosol and a second segment configured to filter a certain component included in the aerosol. Also, as necessary, the filter rod 220 may further include at least one segment configured to perform other functions.

The aerosol generating article 200 may be packaged using at least one wrapper 240. The wrapper 240 may have at least one hole through which external air may be introduced or internal air may be discharged. For example, the aerosol generating article 200 may be packaged by one wrapper 240. As another example, the aerosol generating article 200 may be doubly packaged by two or more wrappers 240. For example, a cigarette rod 210 may be wrapped by a first wrapper 241, and the filter rod 220 may be wrapped by wrappers 242, 243, and 244. Then, the aerosol generating article 200 may be entirely rewrapped by a single wrapper 245. When the filter rod 220 includes a plurality of segments, the respective segments may be wrapped by the wrappers 242, 243, and 244.

The tobacco rod 210 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 210 may be manufactured in various forms. For example, the tobacco rod 210 may be formed as a sheet or a strand. Also, the tobacco rod 210 may be formed as a pipe tobacco, which is formed of tiny bits cut from a tobacco sheet. Also, the tobacco rod 210 may be surrounded by a heat conductive material. For example, the heat conductive material may be, but is not limited to, a metal foil such as aluminum foil. For example, the heat conductive material surrounding the tobacco rod 210 may uniformly distribute heat transmitted to the tobacco rod 210, and thus, the heat conductivity applied to the tobacco rod may be increased and taste of the tobacco may be improved. Also, the heat conductive material surrounding the tobacco rod 210 may function as a susceptor heated by the induction heater. Here, although not illustrated in the drawings, the tobacco rod 210 may further include an additional susceptor, in addition to the heat conductive material surrounding the tobacco rod 210.

The filter rod 220 may include a cellulose acetate filter. Shapes of the filter rod 220 are not limited. For example, the filter rod 220 may include a cylinder-type rod or a tube-type rod having a hollow inside. Also, the filter rod 220 may include a recess-type rod. When the filter rod 220 includes a plurality of segments, at least one of the plurality of segments may have a different shape.

The filter rod 220 may be formed to generate flavors. For example, a flavoring liquid may be injected onto the filter rod 220, or an additional fiber coated with a flavoring liquid may be inserted into the filter rod 220.

Also, the filter rod 220 may include at least one capsule 230. Here, the capsule 230 may generate a flavor or an aerosol. For example, the capsule 230 may have a configuration in which a liquid containing a flavoring material is wrapped with a film. For example, the capsule 230 may have a spherical or cylindrical shape, but is not limited thereto.

When the filter rod 220 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

As another example, although not shown in FIG. 4, the aerosol generating article 200 according to an embodiment may further include a front-end filter. The front-end filter may be located on one side of the tobacco rod 210 which is opposite to the filter rod 220. The front-end filter may prevent the tobacco rod 210 from being detached outwards and prevent the liquefied aerosol from flowing from the tobacco rod 210 into the aerosol generating device (100 of FIGS. 1 through 3), during smoking.

FIG. 5 is a view showing a configuration of an aerosol generating apparatus 500 according to an embodiment.

Referring to FIG. 5, the aerosol generating apparatus 500 may include a heater 510, a puff sensor 520, and a controller 530. As the aerosol generating apparatus 500, the heater 510, and the controller 530 of FIG. 5 may correspond to the aerosol generating apparatus 100, the heater 130, and the controller 120 of FIGS. 1 to 3, respectively, redundant descriptions are omitted.

The heater 510 may heat the aerosol generating article inserted in the aerosol generating apparatus 500, and heat the aerosol generating substrate in the aerosol generating article such that an aerosol is generated from the aerosol generating substrate.

The puff sensor 520 may measure the amount of a user's puff. The amount of a puff may refer to intensity or strength of the puff on the aerosol generating article, and may correspond to the amount of aerosol that the user inhales by the puff.

The puff sensor 520 may measure an amount of a user's puff based on a change in the temperature of the heater, or may measure the amount of a user's puff based on a change in a current flowing through the heater. However, the disclosure is not limited thereto. According to an embodiment, the puff sensor 520 may measure the amount of a user's puff based on a change in the flow of air, a change in the power supplied to the heater, or the like.

The controller 530 may control the heating time (i.e., operating time) of the heater 510. The method of controlling, by the controller 530, the heating time of the heater 510 is described below in detail with reference to FIG. 6.

FIG. 6 is a flowchart of a method of operating an aerosol generating apparatus according to an embodiment.

In operation 610, the aerosol generating apparatus may determine a vaporization amount of the aerosol generating substrate based on a value measured by a puff sensor. In a case where the puff sensor measures an amount of a user's puff based on a change in the temperature of a heater, the measured value may be the temperature of the heater measured by the puff sensor, or a value obtained by converting (e.g., filtering) the temperature of the heater measured by the puff sensor. The vaporization amount may mean the amount of the aerosol generating substrate of an aerosol generating article which is heated and vaporized. Hereinafter, the value measured and output by the puff sensor will be referred to as "puff sensing value."

In a puff occurrence section, a temperature of the heater may change by a user's puff. A greater change in the temperature of the heater may indicate a larger vaporization amount of the aerosol generating substrate. For example, when the temperature change is greater in a second puff occurrence section than in a first puff occurrence section, the aerosol generating apparatus may determine that the vaporization amount of the aerosol generating substrate is larger in the second puff occurrence section than in the first puff occurrence section.

In operation 620, the aerosol generating apparatus may control the heating time of the heater based on the determined vaporization amount. For example, when the vaporization amount of the aerosol generating substrate is determined to be relatively small, the aerosol generating apparatus may increase the heating time of the heater. In another example, when the vaporization amount of the aerosol generating substrate is determined to be large, the aerosol generating apparatus may not increase the heating time of the heater. In this way, the aerosol generating apparatus may make the most of the remaining amount of the aerosol generating substrate. Accordingly, waste of the aerosol generating article may be prevented and user's satisfaction may be increased.

FIG. 7 is a graph showing the temperature of the heater measured by the puff sensor, according to an embodiment.

Referring to FIG. 7, the graph A represents the temperature of the heater measured by the puff sensor according to the heating time of the heater. In FIG. 7, the horizontal axis may denote the heating time of the heater, with the unit time being 0.1 second. In FIG. 7, the vertical axis may denote the temperature (° C.) of the heater measured by the puff sensor.

The puff sensor may measure the temperature of the heater. The temperature of the heater may be changed according to the amount of a puff. For example, the amount of a puff may be proportional to a degree of a decrease in the temperature of the heater measured by the puff sensor.

FIG. 8 is a graph showing a puff sensing value, according to an embodiment.

Referring to FIG. 8, the graph B represents a puff sensing value according to the heating time of the heater. In FIG. 8, the horizontal axis may denote the heating time of the heater, with a unit time being 0.1 second. In FIG. 8, the vertical axis may denote the amplitude of a puff sensing value.

The puff sensor of the aerosol generating apparatus may measure the temperature of the heater and perform digital filtering on the measured temperature to obtain a puff sensing value. By using digital filtering, the temperature of the heater measured by the puff sensor may be flattened.

In an embodiment, the puff sensor may perform digital filtering by using a band pass digital filter. For example, the puff sensor may output the temperature of the heater by using a band pass digital filter in a range of 0.2 Hz to 2 Hz. In another example, the puff sensor may output the measured temperature of the heater by using a band pass digital filter in a range of 0.2 Hz to 0.8 Hz. However, the disclosure is not limited the above examples.

The aerosol generating apparatus may determine the vaporization amount of the aerosol generating substrate based on the puff sensing value. In a puff occurrence section, as a change in the puff sensing value increases, the amount of a puff increases and the vaporization amount of the aerosol generating substrate may be large. For example, referring to FIG. 8, as the change in the puff sensing value is larger between 40 seconds and 42 seconds than between 66 seconds to 68 seconds, the vaporization amount of the aerosol generating substrate may be larger in the section of 40 seconds to 42 seconds than in the second of 66 seconds to 68 seconds.

FIG. 9 is a graph showing the vaporization amount of the aerosol generating substrate, according to an embodiment.

Referring to FIG. 9, the graph A represents the temperature of the heater according to the heating time of the heater, which is measured by the puff sensor. The graph B represents a puff sensing value according to the heating time of the heater. In FIG. 9, the horizontal axis may denote the time for heating the heater, with a unit time being 0.1 second. The left vertical axis may denote the temperature (° C.) of the heater measured by the puff sensor. The right vertical axis may denote the amplitude of the puff sensing value. The horizontal arrow (a) may denote a puff occurrence section, and the vertical arrow (b) may denote a difference between a maximum puff sensing value in each puff occurrence section and a reference threshold value.

The aerosol generating apparatus may determine that a time period in which the puff sensing value is maintained above a reference threshold value is one puff occurrence section. The reference threshold value may be a preset value for determining whether a puff occurs. For example, referring to FIG. 9, the puff sensing value is maintained above the reference threshold value between 8.0 seconds and 8.5 seconds, and thus this section (i.e., time period) may be determined to be a puff occurrence section. Likewise, a section of 41.5 seconds to 42.5 seconds may be determined to be a puff occurrence section. On the other hand, the puff sensing value is less than the reference threshold value between 50.0 seconds and 51.0 seconds, and thus this section may not be determined to be a puff occurrence section.

In an embodiment, the aerosol generating apparatus may measure a difference value by subtracting the reference threshold value from the maximum puff sensing value in the puff occurrence section. For example, the maximum puff sensing value in the puff occurrence section of 8.0 seconds to 8.5 seconds may be 0.28, and the reference threshold value may be 0.17. In this case, the difference value obtained by subtracting the reference threshold value from the maximum puff sensing value may be 0.11.

The difference value may be different according to the vaporization amount of the aerosol generating substrate, and as the difference value increases, the vaporization amount of the aerosol generating substrate may be increased.

In an embodiment, the aerosol generating apparatus may determine the vaporization amount of the aerosol generating substrate based on the difference value. For example, in a section of 8.0 seconds to 8.5 seconds, the difference value may be less than the difference value in a section of 23.0 seconds to 23.5 seconds. In this case, it may be determined that the vaporization amount of the aerosol generating substrate in the section of 23.0 seconds to 23.5 seconds is greater than the vaporization amount of the aerosol generating substrate in the section of 8.0 seconds to 8.5 seconds. In another example, the difference value in the section in which the time for heating the heater is 41.5 seconds to 42.5 seconds may be greater than the difference value in the section of 23.0 seconds to 23.5 seconds. Therefore, it may be determined that the vaporization amount of the aerosol generating substrate is greater in the section of 41.5 seconds to 42.5 seconds than in the section of 23.0 seconds to 23.5 seconds.

The aerosol generating apparatus may accumulate the difference values for each puff occurrence section. Referring to FIG. 9, the aerosol generating apparatus may determine three puff occurrence sections between 0.1 second to 35 seconds. When the difference values of the three puff occurrence sections are 0.31, and 0.3, respectively, the aerosol generating apparatus may calculate that a cumulative total of the difference values is 0.72.

The aerosol generating apparatus may determine the vaporization amount (i.e., consumed amount) of the aerosol generating substrate based on a total vaporization amount of the aerosol generating substrate and the cumulative total of the difference values. The total vaporization amount may be a preset value indicating a total amount of the aerosol generating substrate contained in one aerosol generating article that can be heated and vaporized. The total vaporization amount may be expressed by the amplitude of a digitally filtered signal. For example, the total vaporization amount may be set to an average of the cumulative totals of many aerosol generating articles after a preset number of puffs.

The aerosol generating apparatus may determine the vaporization amount of the aerosol generating substrate and the remaining amount thereof based on the total vaporization amount and the cumulative total of the difference values. Specifically, the aerosol generating apparatus may calculate the remaining amount of the aerosol generating substrate by subtracting the cumulative total from the total vaporization amount of the aerosol generating substrate. For example, when the total vaporization amount is 3.0 and the cumulative total of the difference values is 0.72 at a certain time point, the aerosol generating apparatus may determine that the vaporization amount is 0.72 and the remaining amount is 2.28.

When the remaining amount of the aerosol generating substrate is a preset reference amount or more, the aerosol generating apparatus may increase the preset number of total puffs. The reference amount may correspond to an amount of the aerosol generating substrate needed for a user to puff more than once. The preset number of total puffs may mean the total number of puffs provided by the aerosol generating substrate contained in one aerosol generating article.

The increase in the number of total puffs may vary according to the remaining amount of the aerosol generating substrate. When the remaining amount of the aerosol generating substrate is relatively large, the number of available puffs may be increased much. When the remaining amount of the aerosol generating substrate is relatively small, the number of total puffs may be increased a little. For example, assume the remaining amount of the aerosol generating substrate is 0.1 in an aerosol generating article of which the preset number of total puffs is 14 times. In this case, if the preset reference amount is 0.07, the remaining amount of the aerosol generating substrate is greater than the reference remaining amount. Thus, the aerosol generating apparatus may increase the preset number of total puffs from 14 times to 15 times. If the remaining amount of the aerosol generating substrate is 0.2 in the above example, the aerosol generating apparatus may increase the preset number of total puffs from 14 times to 16 times.

When the remaining amount of the aerosol generating substrate is less than the preset reference amount, the aerosol generating apparatus may maintain the preset number of total puffs. Therefore, if the remaining amount of the aerosol generating substrate is 0.05 in the above example, the aerosol generating apparatus may maintain the preset number of total puffs, 14 times.

When the remaining amount of the aerosol generating substrate is more than the preset reference amount, the aerosol generating apparatus may increase the heating time of a heater. In an embodiment, the aerosol generating apparatus may increase the heating time of a heater to correspond to the increase in the number of total puffs. Accordingly, the user may inhale more aerosol generated from the remaining aerosol generating substrate.

FIG. 10 is a flowchart of a method of controlling, by the aerosol generating apparatus, the heating time of a heater based on a vaporization amount, according to an embodiment. The method of FIG. 10 may be performed by the aerosol generating apparatus. For example, the method of FIG. 10 may be performed by a controller included in the aerosol generating apparatus, such as the controller of FIGS. 1 to 3 and the controller 530 of FIG. 5.

In operation 1010, the aerosol generating apparatus may determine whether there is a section (i.e., time period) in which a puff sensing value is maintained to be more than a reference threshold value.

When there is a period in which a puff sensing value is maintained above a reference threshold value, the aerosol generating apparatus may determine that such period is a puff occurrence section in operation 1020. Otherwise, the aerosol generating apparatus may return to a start operation.

In operation 1030, the aerosol generating apparatus may calculate a difference value of each puff occurrence section and add up difference values.

In operation 1040, the aerosol generating apparatus may count the number of puff occurrence sections. To this end, the aerosol generating apparatus may further include a counter for counting the number of puff occurrence sections. For example, the counter may increase a count value by one whenever a puff occurrence section is detected.

In operation 1050, the aerosol generating apparatus may determine whether the number of remaining puffs reached a preset reference number which is greater than zero. The number of remaining puffs may be obtained by subtracting a counted number of puff occurrence sections from a preset number of total puffs. For example, when the preset number of total puffs is 14 times, the counted number of puff occurrence sections is 11, and the preset reference number is 3, the aerosol generating apparatus may determine that the number of remaining puffs reached the preset reference number.

The preset reference number may indicate a timing for checking the remaining amount of the aerosol generating substrate and adjusting the preset number of total puffs. When the number of remaining puffs reaches the preset reference number, the aerosol generating apparatus may determine the remaining amount of the aerosol generating substrate such that the preset number of the total puffs can be increased before the heater stops a heating operation. Accordingly, the user may continuously puff by using the remaining amount of the aerosol generating substrate according to the increased preset number of total puffs.

When the number of remaining puffs reaches the preset reference number, in operation 1060, the aerosol generating apparatus may determine whether the remaining amount of the aerosol generating substrate is greater than or equal to a preset reference amount. The remaining amount of the aerosol generating substrate may be obtained by subtracting the cumulative total of the difference values from the total vaporization amount of the aerosol generating substrate.

When the remaining amount of the aerosol generating substrate is greater than or equal to a preset reference amount, in operation 1070, the aerosol generating apparatus may increase the preset number of total puffs and/or the heating time of a heater. Otherwise, in operation 1080, the aerosol generating apparatus may maintain the preset number of total puffs and the heating time of a heater.

As the preset number of total puffs and the heating time of a heater are controlled based on whether the remaining amount of the aerosol generating substrate can provide additional puffs, waste of the aerosol generating article may be prevented, and user convenience may be increased.

One embodiment may also be implemented in the form of a recording medium including instructions executable by a computer, such as a program module executable by the computer. The computer-readable recording medium may be any available medium that can be accessed by a computer, including both volatile and nonvolatile media, and both removable and non-removable media. In addition, the computer-readable recording medium may include both a computer storage medium and a communication medium. The computer storage medium includes all of volatile and nonvolatile media, and removable and non-removable media implemented by any method or technology for storage of information such as computer-readable instructions, data structures, program modules, or other data. The communication medium typically includes computer-readable instructions, data structures, other data in modulated data signals such as program modules, or other transmission mechanisms, and includes any information transfer media.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. An aerosol generating apparatus comprising:

a heater configured to heat an aerosol generating substrate;

a puff sensor configured to measure an amount of a user's puff; and a controller configured to determine a vaporization amount of the aerosol generating substrate based on a puff sensing value indicating the amount of the user's puff, and control a heating time of the heater based on the determined vaporization amount, wherein the controller is further configured to:

calculate a difference value by subtracting a reference threshold value from a maximum value of the puff sensing value; and determine the vaporization amount of the aerosol generating substrate based on the difference value.

2. The aerosol generating apparatus of claim 1, wherein the puff sensor is further configured to:

measure a temperature of the heater; and generate the puff sensing value by digitally filtering the temperature of the heater.

3. The aerosol generating apparatus of claim 2, wherein the controller is further configured to determine that a time period in which the puff sensing value is maintained above the reference threshold value is a puff occurrence section.

4. The aerosol generating apparatus of claim 3, further comprising a counter configured to count a number of the puff occurrence section, and the controller is further configured to, when a number of remaining puffs obtained by subtracting the number of the puff occurrence section from a preset number of total puffs reaches a preset reference number, control at least one of the heating time of the heater and the preset number of total puffs based on the determined vaporization amount.

5. The aerosol generating apparatus of claim 3, wherein the controller is further configured to:

calculate a cumulative total of difference values of a plurality of puff occurrence sections; and determine the vaporization amount of the aerosol generating substrate based on a preset total vaporization amount of the aerosol generating substrate and a cumulative total of the difference values.

6. The aerosol generating apparatus of claim 5, wherein the controller is further configured to:

calculate a remaining amount of the aerosol generating substrate by subtracting the cumulative total from the total vaporization amount of the aerosol generating substrate; and when the remaining amount of the aerosol generating substrate is greater than or equal to a preset reference amount, increase a preset number of total puffs of the aerosol generating substrate.

7. The aerosol generating apparatus of claim 5, wherein the controller is further configured to:

calculate a remaining amount of the aerosol generating substrate by subtracting the cumulative total from the total vaporization amount of the aerosol generating substrate; and when the remaining amount of the aerosol generating substrate is less than a preset reference amount, maintain a preset number of total puffs of the aerosol generating substrate.

8. The aerosol generating apparatus of claim 5, wherein the controller is further configured to:

calculate a remaining amount of the aerosol generating substrate by subtracting the cumulative total from the total vaporization amount of the aerosol generating substrate; and when the remaining amount of the aerosol generating substrate is greater than or equal to a preset reference amount, increase the heating time of the heater.

9. A method of controlling an aerosol generating apparatus, the method comprising:

heating an aerosol generating substrate;

measuring an amount of a user's puff by using a puff sensor;

calculating a difference value by subtracting a reference threshold value from a maximum value of a puff sensing value indicating the amount of the user's puff;

determining a vaporization amount of the aerosol generating substrate, based on the difference value; and controlling a heating time of a heater based on the determined vaporization amount.

* * * * *